United States Patent [19]

Corbett

[11] 4,445,852

[45] May 1, 1984

[54] DIFFUSERS

[76] Inventor: Reg D. Corbett, 30103 Clemens Rd., Westlake, Ohio 44145

[21] Appl. No.: 376,265

[22] Filed: May 10, 1982

[51] Int. Cl.[3] ..... C21D 9/00; C21D 1/06; F24H 3/06; F27B 11/00

[52] U.S. Cl. ..... 432/260; 165/122; 266/256; 432/206

[58] Field of Search ..... 432/203, 205, 206, 260; 266/256; 165/122

[56] References Cited

U.S. PATENT DOCUMENTS

| | | | |
|---|---|---|---|
| 3,100,634 | 8/1963 | Rubrecht et al. | 432/260 |
| 3,586,302 | 6/1971 | Corbett, Jr. | 432/260 |
| 4,287,940 | 9/1981 | Corbett, Jr. | 266/256 |
| 4,310,302 | 1/1982 | Thekdi et al. | 432/260 |

*Primary Examiner*—J. Camby
*Attorney, Agent, or Firm*—J. Helen Slough

[57] ABSTRACT

A load support diffuser adapted to support a vertical stack of coils in an annealing furnace and means for cooling a protective atmospheric gas within said furnace, the diffuser comprising a flat circular base plate, a plurality of outer load support members secured to spaced portions of the outer periphery of the base plate, a flow deflecting ramp disposed between each pair of adjacent spaced outer load support members, spaced vertical radial inner load support members spaced inwardly on the base plate from the outer load support members, a cooling member disposed in an annular space provided in the diffuser between said outer and inner support members.

10 Claims, 3 Drawing Figures

DIFFUSERS

My invention relates generally to heat treatment apparatus and to improvements in a charge and diffuser assembly of the type having a plurality of circular cooling tubes disposed therein for use in annealing furnaces.

In heat treating coiled metal strips, particularly in bell-type furnaces, it is the practice to support the coils vertically in stacks on convector plates, the last or lowermost coil being supported on a diffuser plate. The heating of the charge of stacked coils is accomplished largely by convection and, to this end, a suitable fan is disposed in the base of the charge supporting structure for circulating heated non-oxidizing gases or atmosphere outwardly and upwardly within the cover enclosing the charge. With this arrangement, the atmosphere flows downwardly through the center of the stack of coils into the fan and is discharged through the supporting structure around the bottom of the charge. A centrifugal fan of the type shown in U.S. Pat. No. 3,669,563 to R. L. Corbett, Jr. is preferably employed.

In U.S. Pat. No. 4,287,940 to the aforesaid inventor, cooling apparatus is disclosed for diffusers of the type having radial gas flow passages as shown in U.S. Pat. Nos. 3,568,302, 3,716,223 and 3,802,834 are shown.

The present invention is adapted for use in contradistinction thereto for diffuser assemblies of the type having a plurality of circular cooling tubes associated therewith. In the drawings.

Figure 1:
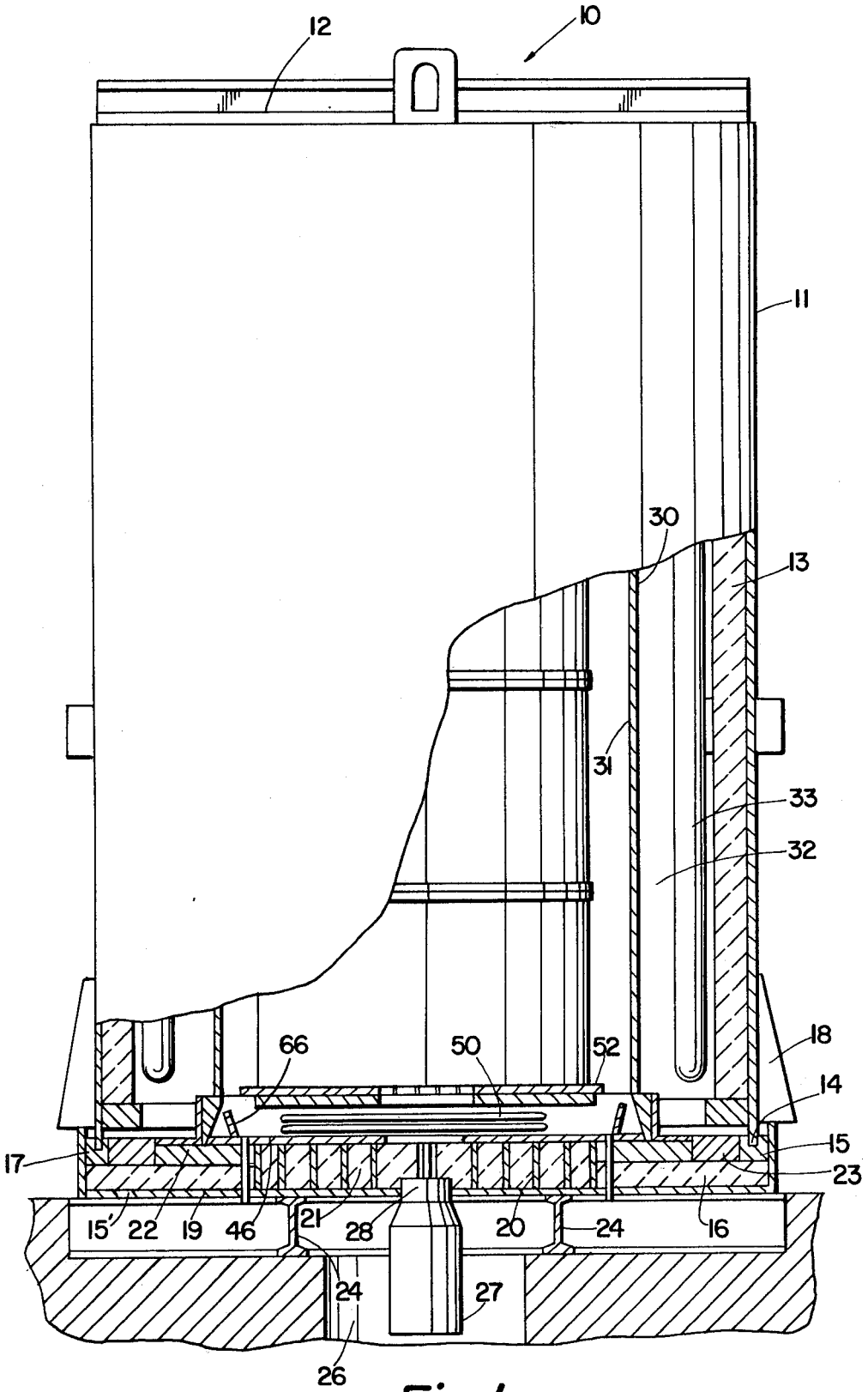
FIG. 1 is an elevational view, partly in elevation and partly in section of a typical annealing furnace containing a stack of coils of metal or stip steel separated by convector plates and supported by the diffuser and cooling assembly of my invention.

Referring now to the invention in all of which like parts are designated by like reference characters, FIG. 1 at 10 shows a hood or bell type furnace of the type shown in FIG. 1 of U.S. Pat. No. 3,802,834 comprising a cylindrical wall body portion 11 having a top closure wall 12 and a suitable refractory lining indicated at 13. The cylindrical body portion is provided with a downwardly projecting annular flange portion 14 which projects downwardly into a granular sealing trough 15 of a generally cup shaped base 16. The base 16 has an upwardly projecting annular flange 17 having a slightly greater diameter than the flange portion 14 whereby said flange position is disposed generally within said annular flange 17. The body portion 11 is supported by radially projecting fins 18 the bottom edges which seat upon the upper edge of the annular flange 17. The base 16 also includes a suitable refractory bottom lining 19 and a central support structure comprising concentric still rings 20 have refractory material 21 disposed therebetween. An annular plate 22 surrounds the concentric rings 20 and a larger annulus 23 is disposed outwardly therefrom and forms the inner wall of the granular sealing trough 15 which contains a suitable granular sealing material 15' such as sand. The body portion 11 may also be sealed by mechanical seals of other types.

The inner cover 30 is preferably disposed radially inwardly of the cylindrical side walls 11 and top closure 12 and is comprised of a cylindrical side wall 31 and top cover wall as shown in U.S. Pat. No. 4,287,940 and is seated on the base structure 16. A chamber 32 is formed intermediate the walls comprising the exterior of the furnace 10 and the inner cover 30. Disposed within this chamber 32 are a plurality of heating means 33.

The base 16, as herein illustrated, is securely mounted upon I-beams 24, which are seated in a concrete floor 25 or other suitable supporting means. A central cavity 26 in the floor affords space for mounting a motor 27 having a shaft 28 which projects upwardly through a central portion of the base 16, the upper end of the shaft carrying a centrifugal fan 29 such as that disclosed and claimed in U.S. Pat. No. 3,669,563 for circulation of the heat-treating gas within the inner cover 30. The diffuser 40 is of a generally annular shape and supports the charge to be heat treated, which charge is placed within the inner cover 30 of the furnace 10 and consists of a stack of sheet metal coils 34 separated from one another by coil separation or convector plates 35 such as those shown in certain of the aforementioned U.S. patents.

The diffuser 40 is of generally annular shape and includes a central opening 42 coincident in location with the eyes or central openings in each of the coils. Heat treating gas is circulated within the inner cover by the fan. The flow of gas is generally radially outward from the central opening 42 through the diffuser 40 and upwardly within the inner cover 30. The circulating gas is caused to wash across the heated side wall 26 whereby the gas itself is heated. Flow paths are provided radially inward through the convector or coil separator plates to the eye or opening within each of the coils in the stack being heat treated, heated gas also passes upwardly within the inner cover 30 to the top cover member 30' to the eye area of the uppermost coil. Flow is then downwardly through the aligned eyes back to the diffuser 40 under the influence of the fan 44.

Figure 2:
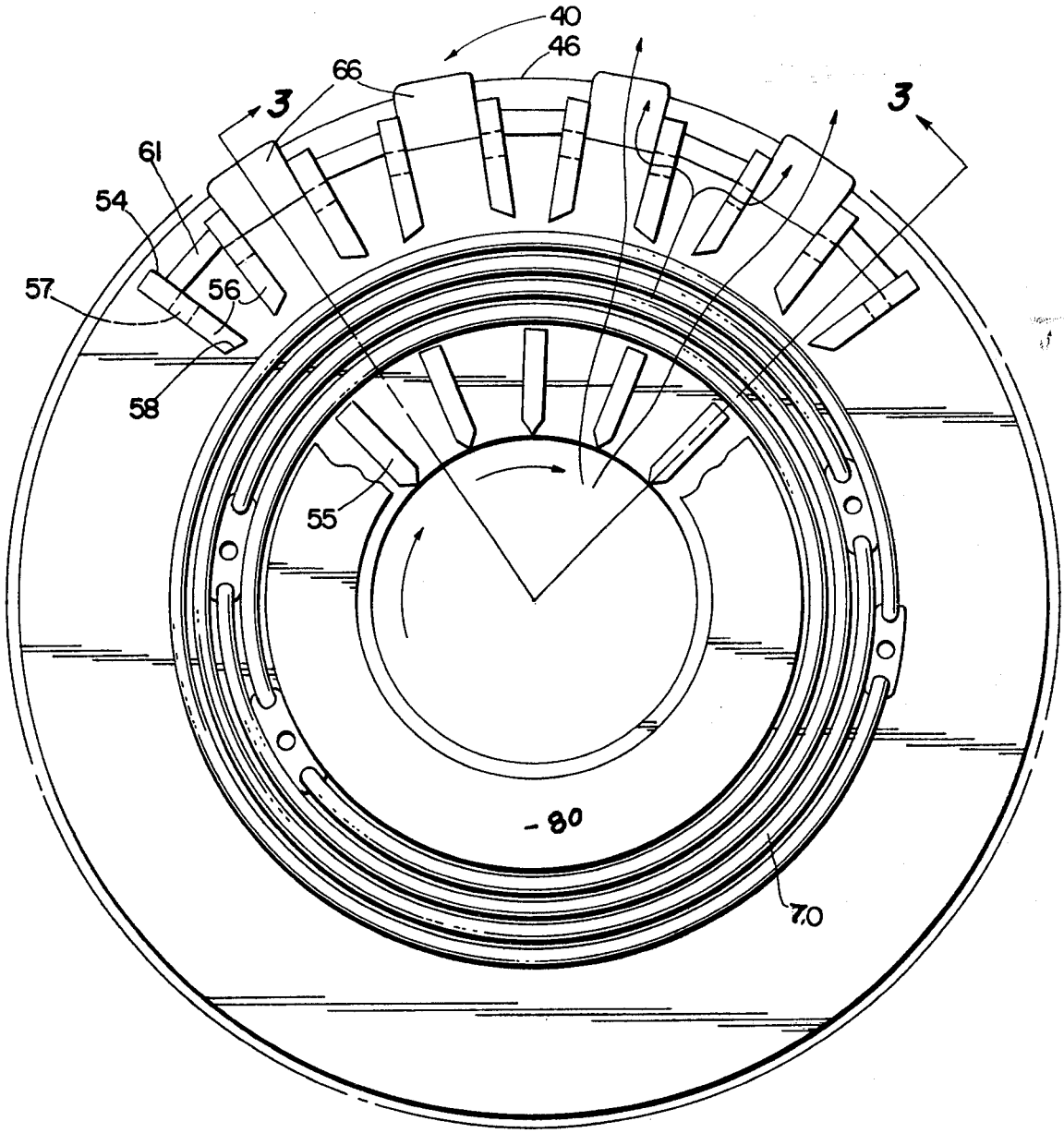
FIG. 2 is a fragmentary plan view of the diffuser of my invention.

The diffuser assembly 40 includes a load plate designated generally at 52, a base plate 46, cooling means designated generally at 50, a plurality of outer and inner support members and flow dividers 54 and 55 respectively, as shown in FIG. 2. Each of the outer support members 54 comprises a pair of radial relatively short spaced vertical load supporting and flow deflecting wall members 56, secured, as by welding, to the base plate 46, and a transverse vertical rear wall 61 secured, as by welding, to the base plate 46 and side walls 54, to form a U-shaped flow passage therein. The wall members 56 are provided with openings 57 in the rear lower portions of each which act as exhaust openings from which gas in the U-shaped flow passages exits into a passage formed by a flow deflector ramp 66 angled outwardly and upwardly, which ramp is disposed between and secured to each of the U-shaped support and flow deflector members 54. The ramp is secured further, as by welding, to the base plate 46 and the gas is conducted, by the ramp, toward the cylindrical side wall 31 of the inner cover 30, as indicated by arrows in FIG. 2.

A plurality of spaced inner support and flow deflector members are provided as shown at 55 and said members consist of short vertical radially extending members 55 initiating at the inner periphery of the diffuser adjacent the central opening 42 in the diffuser. Each member 55 is spaced inwardly from the outer support members 54 and each is disposed in alignment with the center axis of a gas passage provided between the radial walls of an outer support member. The inner members 55 thereby cooperate with the U-shaped passages, the openings therein and the flow deflector ramps to provide a path for the gas circulated outwardly from the eye of the diffuser to the furnace inner cover.

In the central annular circumferential space provided by the different structure 40 between the inner ends of the outer support walls and the outer ends of the inner support walls and above the base plate 46, a plurality of tubular cooling members 70 are disposed in free standing position. As shown, two rows of three coils each are used, each coil having an inlet at one end and an outlet at an opposite end for continuous flow of cooling fluid through the tubular members or coils, the inlet and outlet ends preferably initiating and exiting below the diffuser into the cavity below the furnace floor, (not shown).

It is to be noted that the separate coils 70 are preferably arcuate in form and, as shown, when secured together form cooling members ring-like in form circumscribing and disposed within the medial area of the diffuser and interposed between the outer and inner support members transverse to the path of the gas circulated from the eye of the diffuser outwardly on either side of the inner plate support members 55 into the U-shaped space provided by adjacent pairs of the outer plate support wall members 54. Note in FIG. 2 the path of the gas is designated by arrows from the eye or flue of the furnace as blown by the fan, and passes on either side of the divider and support member 55 into the U-shaped passage between the vertical rear walls 56 through the openings 57 in said walls, exiting over the ramps 66 and directed thereby onto the circumferential walls 31 of the inner cover 30.

The gas is passed through and around the free standing cooling tubes in the gas passage determined by the inner and outer support members 55 and 54 respectively.

Figure 3:
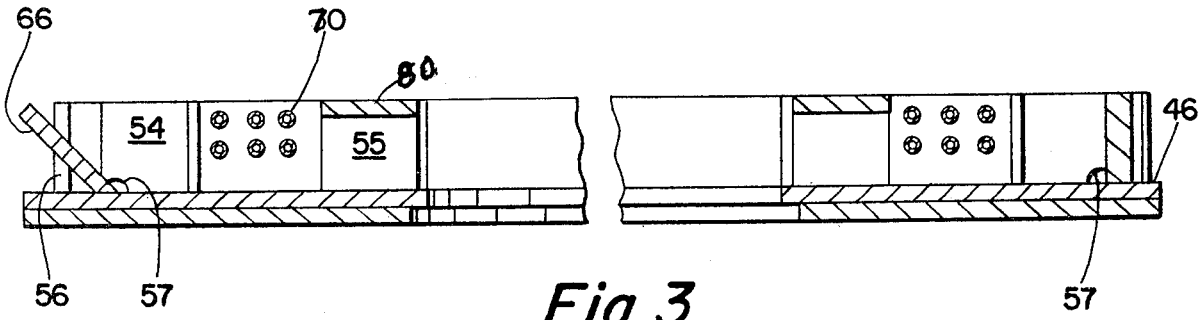
FIG. 3 is a vertical cross-sectional view taken substantially on line 3—3 of FIG. 2.

A flat annular circular band 80 overlies and is secured as by welding to the upper edges of the inner support and flow deflector members 55, as best illustrated in FIGS. 2 and 3. Said band also functions as a further flow deflector and load support means.

Although I have described my invention in connection with a preferred embodiment, I am aware that numerous and extensive departures may be made therein without however, departing from the spirit of my invention, and the scope of the appended claims. What I claim is:

1. A diffuser assembly for transmitting thermal energy by conduction across metallic members and convection of a heat-treating gas in an annealing furnace comprising:

(a) a diffuser member having a generally annular shape defined by inner and outer peripheries; and provided with a central eye within which a fan is disposed, said diffuser member comprising:

(i) a base plate;

(ii) a plurality of outer load support members secured to spaced portions of the outer periphery of said base plate, each outer load support member comprising a pair of spaced radial vertical wall members and a transverse vertical rear wall forming substantially U-shaped gas passages between said vertical wall members of said outer load support members;

(iii) a flow deflecting ramp disposed between each pair of adjacent spaced outer load support members;

(iv) a plurality of spaced vertical radial inner load support members spaced inwardly on the base place from the outer load support members, each inner load support member initiating at the inner periphery of the base plate and disposed in alignment with the center axis of one of said U-shaped gas flow passages;

(v) a tubular ring-like cooling member disposed in an annular space provided in the diffuser between said outer and inner support members and transverse to the path of gas flow, the gas being circulated by the fan out of the eye of the diffuser and diverted by the inner load support members to cause flow of said gas on either side of the said inner load support members and about the cooling member into the U-shaped gas passages and over said ramps.

2. The diffuser of claim 1 wherein each of said spaced radial vertical walls of said outer load support members is provided with an opening through which the gas flows from each said U-formed gas passage over said ramp.

3. The diffuser of claim 2 wherein each said opening is disposed in the bottom and at the rear of each said radial vertical wall.

4. The diffuser of claim 1 wherein the cooling member comprises a plurality of arcuate members formed into a coil.

5. The diffuser of claim 1 wherein the cooling member is a free standing member.

6. The diffuser of claim 1 wherein the transverse rear wall of said outer load support wall members is secured at each end to one of said pair of spaced radial walls.

7. The diffuser of claim 1 wherein each flow deflecting ramps is outwardly and upwardly angled.

8. A diffuser assembly as claimed in claim 1 wherein the inner load support members are secured to the base plate.

9. A diffuser assembly as claimed in claim 1 wherein each of the ramps is secured to a facing radial vertical wall member of each of said adjacent outer load support members.

10. A diffuser assembly as claimed in claim 1 wherein a flat circular band overlies the inner load support members.

* * * * *

UNITED STATES PATENT AND TRADEMARK OFFICE

CERTIFICATE OF CORRECTION

PATENT NO. : 4,445,852

DATED : May 1, 1984

INVENTOR(S) : REG D. CORBETT

It is certified that error appears in the above-identified patent and that said Letters Patent is hereby corrected as shown below:

Column 4, line 45, claim 7, should correctly read as follows:

7. The diffuser of claim 1 wherein each flow deflecting ramp is outwardly and upwardly angled.

Signed and Sealed this

*Twenty-eighth* Day of *August 1984*

[SEAL]

*Attest:*

GERALD J. MOSSINGHOFF

*Attesting Officer*

*Commissioner of Patents and Trademarks*